US012584282B1

(12) United States Patent
Fromm et al.

(10) Patent No.: US 12,584,282 B1
(45) Date of Patent: Mar. 24, 2026

(54) PORTABLE, REUSABLE, HIGH-STABILITY, CLOG-RESISTANT, UNIVERSAL-APPLICATION, ADJUSTABLE-VOLUME NON-FILTRATION FLOW REGULATION DEVICE AND SYSTEM FOR SEDIMENTATION CONTROL RELATED APPLICATIONS

(71) Applicants: Mark A. Fromm, Defuniak Springs, FL (US); John M. Woodbury, Jr., Defuniak Springs, FL (US)

(72) Inventors: Mark A. Fromm, Defuniak Springs, FL (US); John M. Woodbury, Jr., Defuniak Springs, FL (US)

( * ) Notice: Subject to any disclaimer, the term of this patent is extended or adjusted under 35 U.S.C. 154(b) by 442 days.

(21) Appl. No.: 16/503,775

(22) Filed: Jul. 5, 2019

Related U.S. Application Data

(63) Continuation of application No. 14/852,606, filed on Sep. 13, 2015, now abandoned.

(51) Int. Cl.
*E02B 3/10* (2006.01)
*E02B 3/02* (2006.01)
*E02B 5/08* (2006.01)

(52) U.S. Cl.
CPC ..... *E02B 3/108* (2013.01); *E02B 3/023* (2013.01); *E02B 5/085* (2013.01)

(58) Field of Classification Search
CPC ..... E02D 3/108; E02D 3/023; E02B 5/085
USPC ..... 405/108
See application file for complete search history.

(56) References Cited

U.S. PATENT DOCUMENTS 7,226,240 B2 6/2007 Tyler
7,452,165 B2 11/2008 Tyler
9,181,668 B1 * 11/2015 Hill ..... E02B 3/122
2005/0254899 A1 * 11/2005 Tyler ..... E02D 17/20 405/15
2007/0166106 A1 * 7/2007 Koerner ..... E02B 11/005 405/16
2009/0266767 A1 * 10/2009 McInnis ..... E02B 3/108 210/170.03

(Continued)

*Primary Examiner* — Tara Schimpf
*Assistant Examiner* — Patrick F Lambe
(74) *Attorney, Agent, or Firm* — Gugliotta & Gugliotta LPA

(57) ABSTRACT

An erosion prevention and sedimentation control flow-regulation device and system is provided for all customary applications addressed by conventional filtration devices such as check-dams (ditch check, channel or culvert), inlets (curb and ground), slope (hillside), perimeter control and settling and other ponds. The flow-regulation device and system is comprised of two components: (1) a heavy, irregular-shaped, hard-wearing, non-filtering, high-porosity fill media encapsulated in a heavy-duty, high-tensile mesh (the 'high-porosity particle mix component'), and (2) an optional sheet-like synthetic geotextile material with limited permeability (the 'low-permeability choker component'). The high-porosity particle mix component allows much larger flows of water through the device and system. The low-permeability choker component constricts or 'chokes' the flow of water into the high-porosity particle mix component. The instant abstract is neither intended to define the invention disclosed in this specification nor intended to limit the scope of the invention in any way.

16 Claims, 15 Drawing Sheets

(56) References Cited

U.S. PATENT DOCUMENTS

| | | | | |
|---|---|---|---|---|
| 2010/0232882 | A1* | 9/2010 | Tasker | E02B 3/127<br>405/107 |
| 2011/0233140 | A1* | 9/2011 | Berger | E02B 3/023<br>210/170.1 |
| 2012/0020745 | A1* | 1/2012 | Miller | E02D 29/0241<br>405/284 |
| 2014/0064851 | A1* | 3/2014 | Nankervis | E02B 5/085<br>405/36 |

* cited by examiner

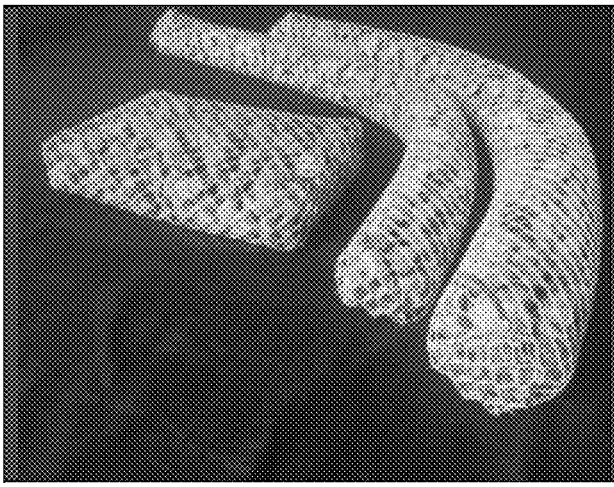

FIG. 9
Close-up View of Variants of Preferred High-Porosity Particle Mix Component Embodiment

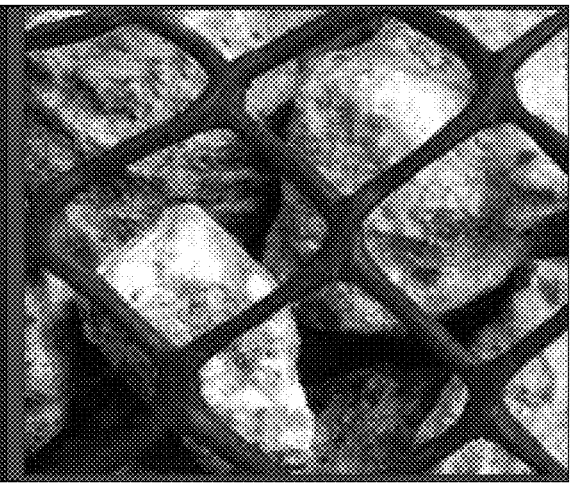

FIG. 10
Close-up View Illustrating Size of Mesh Aperture and Width of Strands Relative to Size of Irregularly-Shaped Particles Used For Preferred Tubular Embodiment

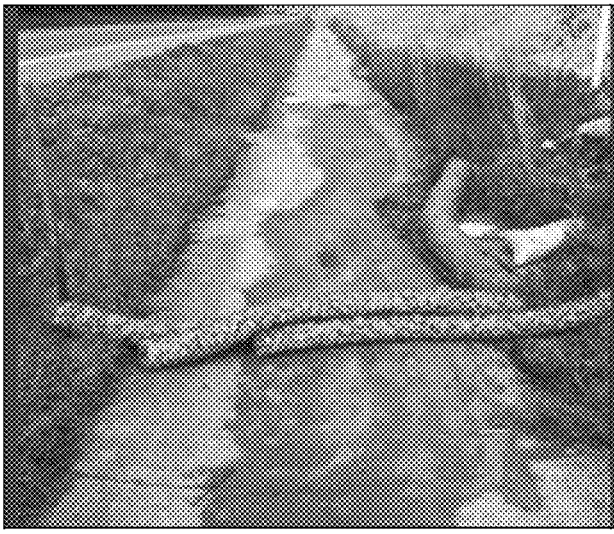

FIG. 11
Illustration of Medium-Scale Check Dam Assembly replacing a Staked Straw Wattle Pushed Aside by Hydrostatic and Hydrodynamic Forces of Water Flow

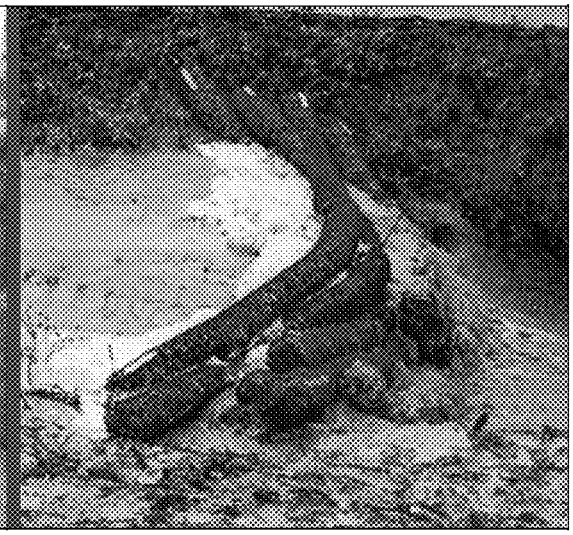

FIG. 12
Illustration of Sedimentation Settling Pond Created Behind Large-Scale Check Dam Assembly Illustration of Accumulated Sedimentation behind Large-Scale Check Dam Assembly Illustration of Large-Scale Check Dam Assembly at Base of 15° Slope Running into Bayou Illustration of Large-Scale Road Culvert Assembly Illustration of Small-Scale Culvert Inlet Assembly with Low-Permeability Choker Overlay Illustration of Curb Inlet Assembly Illustration of Curb Inlet Assemby with Low-Permeability Choker Wrap Illustration of Small-Scale Ground Inlet Assembly Illustration of Single-line Silt Fence Support Assembly for Small Ground Inlet Illustration of Large-Scale Ground Inlet Assembly Illustration of Large-Scale Ground Inlet Assembly with Low-Permeability Choker Overlay Illustration of Single-line Perimeter Control Assembly Illustration of Triple-line Slope Control Assembly Illustration of Series of Creek Control Assemblies Illustration of Large Sediment Settling Pond Assembly With Low-Permeability Choker Overlay Discharging over a Property Line into Wetlands Illustration of Man-Portability Illustration of Damage/Crushing Resistance from Site Traffic

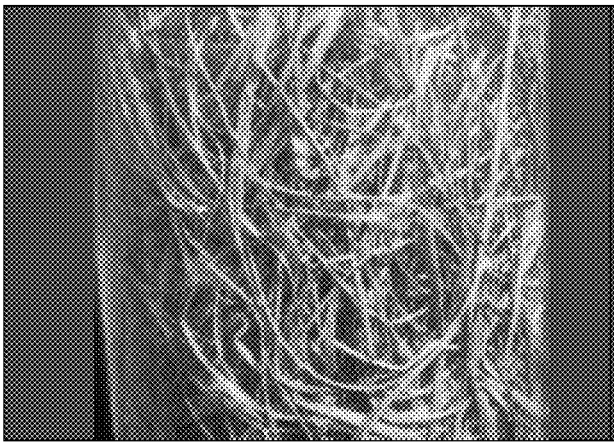

FIG. 29
View Illustrating Size of Porosity Pathways and Pockets of Unsaturated, Uncompressed Straw

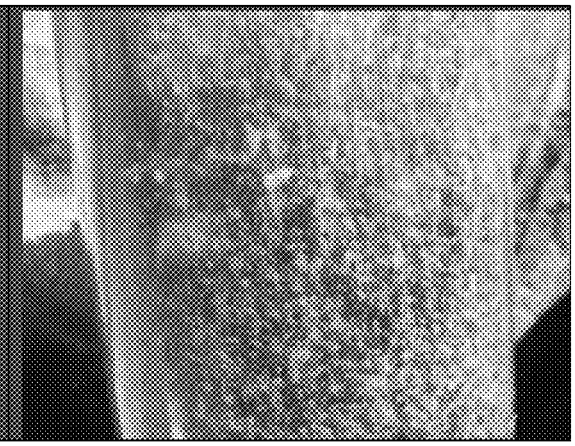

FIG. 30
View Illustrating Size of Porosity Pathways and Pockets of Unsaturated, Uncompressed Compost

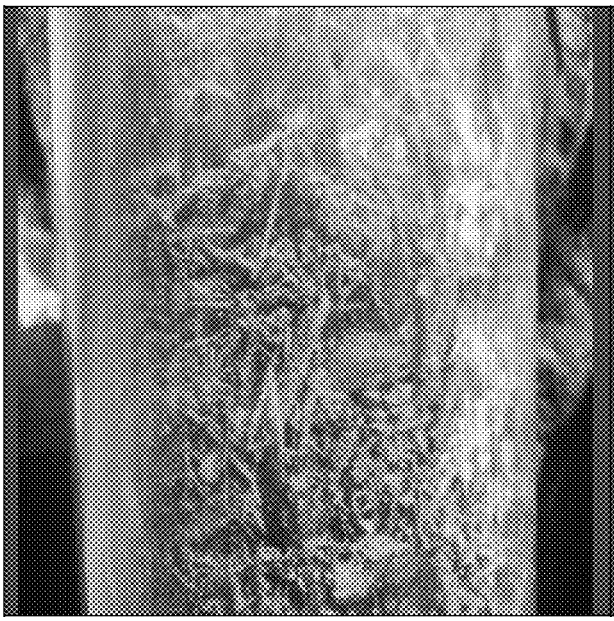

FIG. 31
View Illustrating Size of Porosity Pathways and Pockets of Unsaturated, Uncompressed Bark

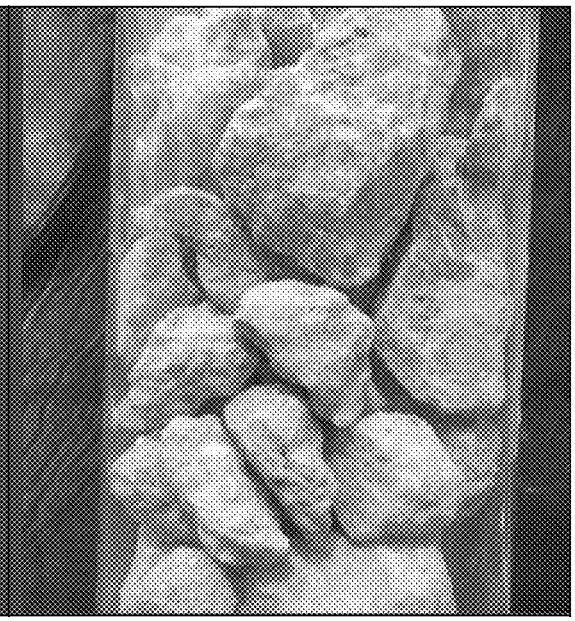

FIG. 32
View Illustrating Size of Porosity Pathways and Pockets of 4–1" Crushed Concrete Mix View Illustrating Size of Porosity Pathways and Pockets of ¼" Natural Pea Gravel View Illustrating Size of Porosity Pathways and Pockets of 2½–1" Natural Gravel Mix

PORTABLE, REUSABLE, HIGH-STABILITY, CLOG-RESISTANT, UNIVERSAL-APPLICATION, ADJUSTABLE-VOLUME NON-FILTRATION FLOW REGULATION DEVICE AND SYSTEM FOR SEDIMENTATION CONTROL RELATED APPLICATIONS

RELATED APPLICATIONS

The Present Invention is a Continuation in Part of U.S. application Ser. No. 14/852,606 (the '606 Patent Application'), filed on Sep. 13, 2015 and incorporated herein by reference as if fully rewritten herein. To Applicant's knowledge, there are no other previously filed, nor currently any co-pending applications, anywhere in the world.

BACKGROUND OF THE INVENTION

1. Field of the Invention

The Present Invention (as hereinbelow defined) relates generally to systems for and methods of erosion prevention and sedimentation control and, more particularly, toa high-flow velocity water flow and sediment control devices for portable, durable use.

2. Description of the Related Art

In areas denuded of vegetation, soil can be easily washed away (called 'sedimentation') by rain or other water flow events. Washed-away sedimentation can cause major environmental problems downstream which can be very costly to remediate, including physical and biological damage to aquatic areas and to private and public lands. Much legislation, such as the Clean Water Act, puts the onus on the landowner/contractor to install safeguards to prevent erosion and sedimentation and some applications, such as highway construction projects, are subject to continuous inspection and environmental fines.

Currently used to control erosion and sedimentation are for such control three-dimensional bale, wattle and tubular-shaped filtration devices for the erosion prevention and sedimentation control applications customarily addressed by these types of filtration devices including, by way of example and not limitation, check-dams (ditch check, channel or culvert), inlets (curb and ground), slope control (hillside), perimeter control (boundary) and settling and other types of ponds (collectively referred to herein as 'Customary Field Applications'). Also currently used are silt fences, a two-dimensional filtration device in which a porous geotextile material is hung like a curtain parallel to the ground on stakes, principally as a perimeter control device. The aforesaid filtration devices (collectively referred to herein as 'Conventional Filtration Devices') would be considered to be a subset of erosion prevention and sedimentation control devices and systems in the industry consisting of lower cost & complexity filtration-based devices and systems. As will be discussed below, the Present Invention is a non-filtration device and, as such, is in a separate class of devices notwithstanding that it competes with filtration devices.

The original three-dimensional Conventional Filtration Devices are straw bales, in which straw is encapsulated in a wire or cotton netting. Later variants of this device are straw wattles or logs, which are more or less rhomboidal or tubular-shaped variants of straw bales. More recently, fill media for wattles and logs has evolved to include a variety of light-weight, compact, organic, low-porosity materials, including compost (organic waste), bark, wood chips, wood shavings, coir (coconut fiber) and humus. In addition, netting has evolved to include lightweight, biodegradable polymer netting or mesh, appropriate for encapsulating light-weight organic filtration media.

All of the organic filtration materials, and the natural netting materials, used in Conventional Filtration Devices biodegrade or decompose relatively quickly, especially when faced with the elements in general, and hydrostatic and hydrodynamic forces and the pressures of sedimentation in particular. Once used for a single Customary Field Application, Conventional Filtration Devices cannot be moved much less reused.

Conventional Filtration Devices accomplish their objective of either preventing soil from eroding in the first place at the source (erosion prevention), such as slope control devices, or by capturing the sedimentation contained in sheet or stream flows downstream before exiting the general location (sedimentation control), such as a check dam, inlet protection and perimeter control devices.

Based upon the current teaching of the Art, when placed across a sheet or stream flow, the primary function of Conventional Filtration Devices as taught is to keep sediment on-site by capturing the sediment within the device while allowing relatively sedimentation-free filtered water from rain or other sources to flow through the device and then downstream/downhill and off property. The secondary function of the device as taught is to create a temporary settling pond upstream of the device due to the slowing of the water as it flows through the device, leading to additional sedimentation-capture as the water slows down in terms of speed and turbulence and suspended sedimentation drops to the bottom of the pool. After the conclusion of the rain or water flow event, the settling pond will finish draining through the device, and the accumulated sediment will be removed to create space for future impound events.

The current state of the art with respect to Conventional Filtration Devices is to employ soft, lightweight, compact, organic, low-porosity filtration medias as it is taught in the industry that highly-compactible, low-porosity filtration medias are required to constrict the size of porosity pathways to the maximum extent in order to maximize the capture of sediment within the High-Porosity Particle Mix Component through the filtering mechanism.

A typical tubular Conventional Filtration Device is the one described in U.S. Patent Application Publication US 0/024899, published in the name of Tyler ('Patent Application Pub '899') which employs a light-weight, proprietary compost or bark filtration media as its preferential fill media (the '899 Device'). See FIG. 10 and FIG. 11 to observe how compact compost and bark are. The focus on teaching the use of a small-diameter filtration media such as compost and bark for water filtration applications for the '899 device is illustrated in paragraph 26 of Patent Application Pub '899, which teaches the following in terms of employing the High-Porosity Particle Mix Component claimed in Patent Application Pub '899 for water filtration applications:

> "In certain embodiments, such as perhaps those involving water filtration [EMPHASIS ADDED], the particle size of the compost can conform to the following: 99% passing a 1 inch sieve, 90% passing a 0.75 inch sieve, a minimum of 70% greater than a 0.375 inch sieve, and/or less than 2% exceeding 3 inches in length. The mean, median, minimum, and/or maximum size of the compost can be varied according to the application. For example, if increased filtering [emphasis added] is desired, or if no sediment is trapped upstream of the tube, the size of the compost can be decreased, or better ground contact can be attempted. Conversely, if too much water is retained in, for example, an erosion-prevention application, the size of the compost can be increased."

Consistent with the sales and marketing materials relating to the '899 device such as sediment/perimeter control, inlet protection, check dams and slope interruption, the Patent Application Pub '899 holder expands on its teaching on the primacy of filtration. Specifically, for each of the aforesaid three applications, the Patent Application Pub '899 holder refers to the '899 device as a 'three-dimensional tubular sediment control and stormwater runoff filtration device [emphasis added], and then goes to state that their device 'traps sediment and soluble pollutants primarily by filtering [ORIGINAL EMPHASIS] stormwater as it passes through the matrix of [the '899 device] and secondarily [ORIGINAL EMPHASIS] by allowing water to temporarily pond behind [the '899 device], allowing deposition of suspended solids'.[i]

[i] See sections 1.1, 1.2, 1.3 and 1.5 of Design Manual, relating to sediment control, inlet protection, check dam and slope interruption devices and applications, respectively.

Also consistent, the Patent Application Pub '899 holder further explains the teaching as it relates to the use of small particle sizes for water filtration applications in its research materials, where it discusses the inverse relationship between the diameter of filtration materials and flow-through rate of the water (e.g., porosity), and presents a chart showing an 'Optimum Performance Zone' indicating that the optimum particle sizes range from approximately 4.5/10th of an inch in diameter for the smallest particle in and approximately 1.1 inch in diameter for the largest particle[ii].

[ii] See Research Appendix #3330

IT IS PREFERABLE THAT AN IMPROVED FILTRATION SOCK WOULD BE HEAVY ENOUGH TO PREVENT MOVEMENT OR UNDERCUTTING BY FLOWING WATER, BE DURABLE ENOUGH FOR REPEATED USE WHILE STILL BEING EASILY PORTABLE, TRANSPORTABLE OR POSITIONAL, AND PROVIDE A PORE STRUCTURE THAT IS BOTH NOT EASILY CLOGGED WHILE STILL BEING EFFECTIVE FOR CONTROLLING WATER FLOW, SOIL EROSION AND SEDIMENT FLOW IN AND AROUND A CONSTRUCTION OR SITE OR ANY OTHER SITE IN NEED OF SUCH CONTROL.

A SUMMARY OF THE PRESENT INVENTION

3. Overview of Design

It is thus an object of the present invention to provide an improved system for erosion control.

It is a feature of the present invention to provide a system for erosion control that includes larger pore passages and opening sizes having nonlinear, multi-axial tortuous fluid flow paths therethrough, providing higher filtrate flow rates while still effectively separating any sediment or filtrides.

The present invention addresses the limitations of prior art devices through unexpected results discovered via trial and error. The key inventive elements include:

1. Allowing water to flow through the device at high fluid flow rates.
2. Creating a tortuous fluid path through aggregate/rock fill material.
3. Utilizing the momentum of solids to cause retention while liquid passes through.

To achieve these results, the invention comprises:

a. Surface pores large enough to prevent clogging by sediment.
b. A specific porosity or overall void volume density within the aggregate/rock fill material to allow rapidly flowing fluid to pass while retaining filtered solids.
c. A durable, strong retaining mesh to contain the aggregate/rock fill, enabling portability without spillage or breakage. Briefly described according to the present invention, a rock filled non-seamed mesh tube for flow control is provided comprised of a cylinder mesh tube that is a closed or continuous loop cylinder. There are no seams that run along the length (longitudinally) of the mesh tube. The mesh tube is manufactured in the closed cylinder architecture via an appropriate process for producing the closed cylinder such as extrusion. The mesh tube has a closed or closable first end, a closed or closable second end and a medial portion there between. The mesh tube has a series of openings each having a first diameter. A quantity of rock aggregate (defined to include concrete and LEED concrete pieces) is provided and is disposed within the mesh tube between the first end and the second end. The rock is of cobble size and is specifically between about 1 inch to about 4 inches in size. At least a majority of the rock has a second diameter that is greater than the first diameter of the openings in order to help prevent rock escape from the mesh tube.

The mesh tube may be formed of a porous polymer membrane that may be made from high density polyethylene, polypropylene, polyester, nylon, or other appropriate woven fabric or similar material. The mesh tube may be formed as a closed cylinder. According to a preferred embodiment of the present invention, the mesh tube need not have a longitudinal seam running along its length.

Disposed within the interior of the cylinder of the mesh tube is a volume of rock aggregate. By way of example, and not meant as a limitation, the use of rock or stone aggregate may include crushed concrete or crushed concrete from LEED sources, such as demolished broken up driveways, etc. The rock aggregate is preferably formed of a plurality of individual items of rock that are on average each of cobble-size or slightly smaller than cobble-size. According to a preferred aspect of the present invention, the rock aggregate is formed of individual rocks that are within a size range of between approximately 1 inch to approximately 4 inches in size.

This particular range of sizes of rocks is particularly effective for the functional task at hand. Similarly, the use of generally non-smooth aggregate, such as irregular or partly rounded, angular or flaky aggregates are similarly better suited for providing multi-axial tortuous fluid flow paths "C".

Advantages of the present invention provide erosion control system elements that overcome the drawbacks of the prior art. The present invention does not easily harbor weeds nor other contaminants that can ecologically pollute a site where such a device is installed. Devices within the present system have a relatively long life span such that the devices can be reused with the expense of device replacement minimized.

Being relatively inexpensive to produce and not unduly difficult to install or maintain, the use of rock filled non-seamed mesh tubes for flow controls include larger and variable pore sizes are less prone to clogging, easily cleaned if they do clog, are not susceptible to being undercut or pushed aside by higher water flow.

BRIEF DESCRIPTION OF DRAWINGS AND PHOTOS

The advantages and features of the Present Invention as described elsewhere in this patent application (including the background hereinabove provided and the Preferred High-Porosity Particle Mix Component Embodiment and variations thereof and claims hereafter presented) will be better understood in conjunction with the accompanying drawings and photos, in which like elements are identified with like symbols, and in which:

FIG. 1 is a schematic view of the nonlinear, multi-axial, tortuous fluid flow pathways and pockets resulting from the employment of different sizes and irregular-shapes of heavy, solid, irregular-shaped fill media.

(A) FIG. 2 is a perspective view of the High-Porosity Particle Mix Component in a tubular configuration consisting of a polymer mesh encapsulating heavy, solid, and irregular-shaped fill media particles.

(B) FIG. 3 is a perspective view of the aforesaid tubular mesh configuration and encapsulated fill media particles shown in FIG. 1;

(C) FIG. 4 is a close-up view of a portion of the aforesaid tubular mesh configuration and encapsulated fill media particles taken from a top perspective.

(D) FIG. 5 is a close-up view of a portion of the aforesaid tubular mesh configuration and encapsulated fill media particles taken from a side perspective, showing the elongate flat stripe component.

(E) FIG. 6 is a schematic view of the placement of a Low-Permeability Choker Overlay on the upstream side of the heavy, solid, irregular-shaped fill media shown in FIG. 5.

FIG. 7 is a chart showing the 'Optimum Performance Zone' indicating that the optimum particle sizes range from approximately 4.5/10th of an inch in diameter for the smallest particle in and approximately 1.1 inch in diameter for the largest particle[iii].

[iii] See Research Appendix #3330

FIG. 9 is a close-up view illustrating several variants of the Preferred High-Porosity Particle Mix Component Embodiment.

FIG. 10 is a close-up view illustrating the size of the mesh apertures and width of strands relative to size of irregularly-shaped fill media particles used for Applicant's Preferred 4.5" D High-Porosity Mesh Embodiment described below which is a version illustrating the above perspective views.

FIG. 11 is an environmental view of a support assembly for drainage from a large sediment settling pond draining into adjoining environmentally-protected wetlands assembled using Applicant's Preferred 4.5" D High-Porosity Mesh Embodiment, which illustrates the employment of a Low-Permeability Choker Overlay placed on the up-stream portion of the settling pond assembly.

FIG. 12 is an environmental illustration of a sedimentation settling pond created behind a medium to large-scale check dam assembly;

Figure 28:
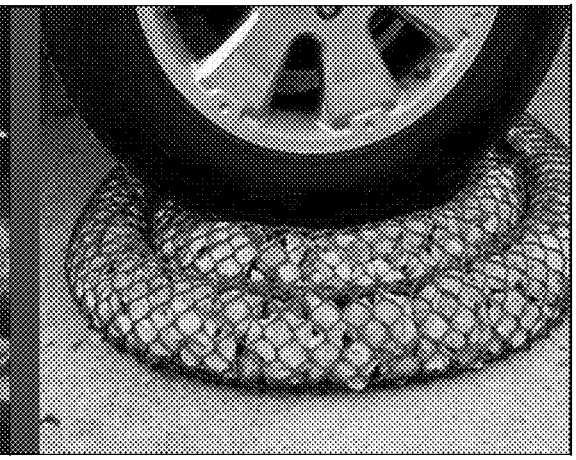
Figure 33:
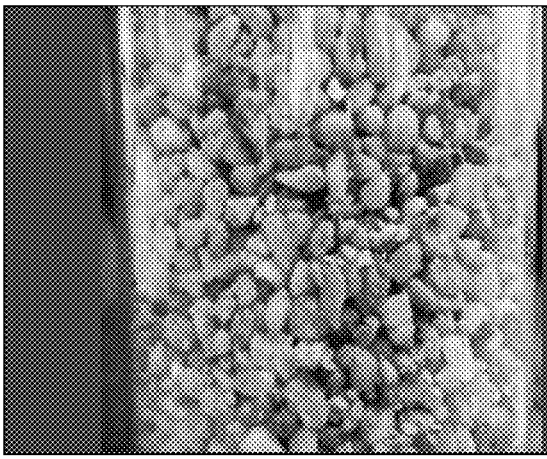
Figure 34:
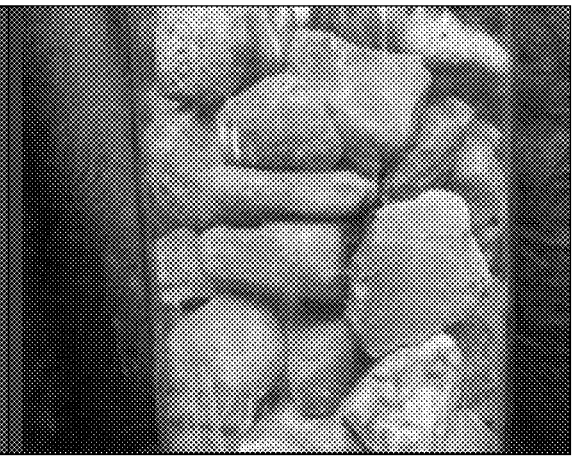

FIG. 28 I an illustration of a typical damage/crushing resistance of the present invention;

FIG. 29 through FIG. 31 depict common filtration media for Conventional Filtration Devices are straw (see FIG. 29), compost (see FIG. 30) and bark (see FIG. 31);

FIG. 32 shows an approximate material mix of 4-1" crushed concrete mix crushed concrete contained in an acrylic tubular vessel; and FIG. 33 and FIG. 34 showing ¼" natural pea gravel and 2½-1" natural gravel mix, respectively.

Figure 1:
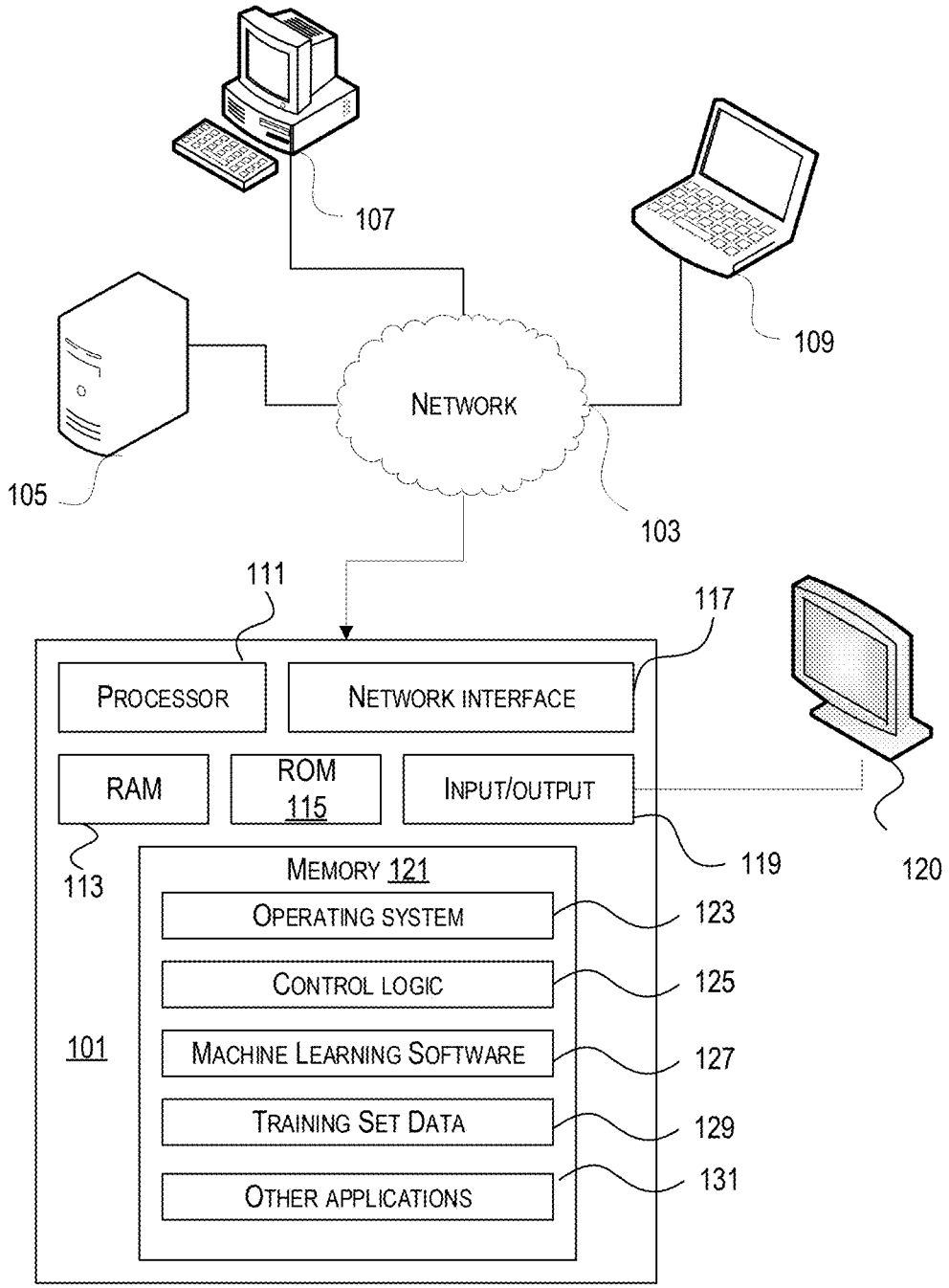
Figure 2:
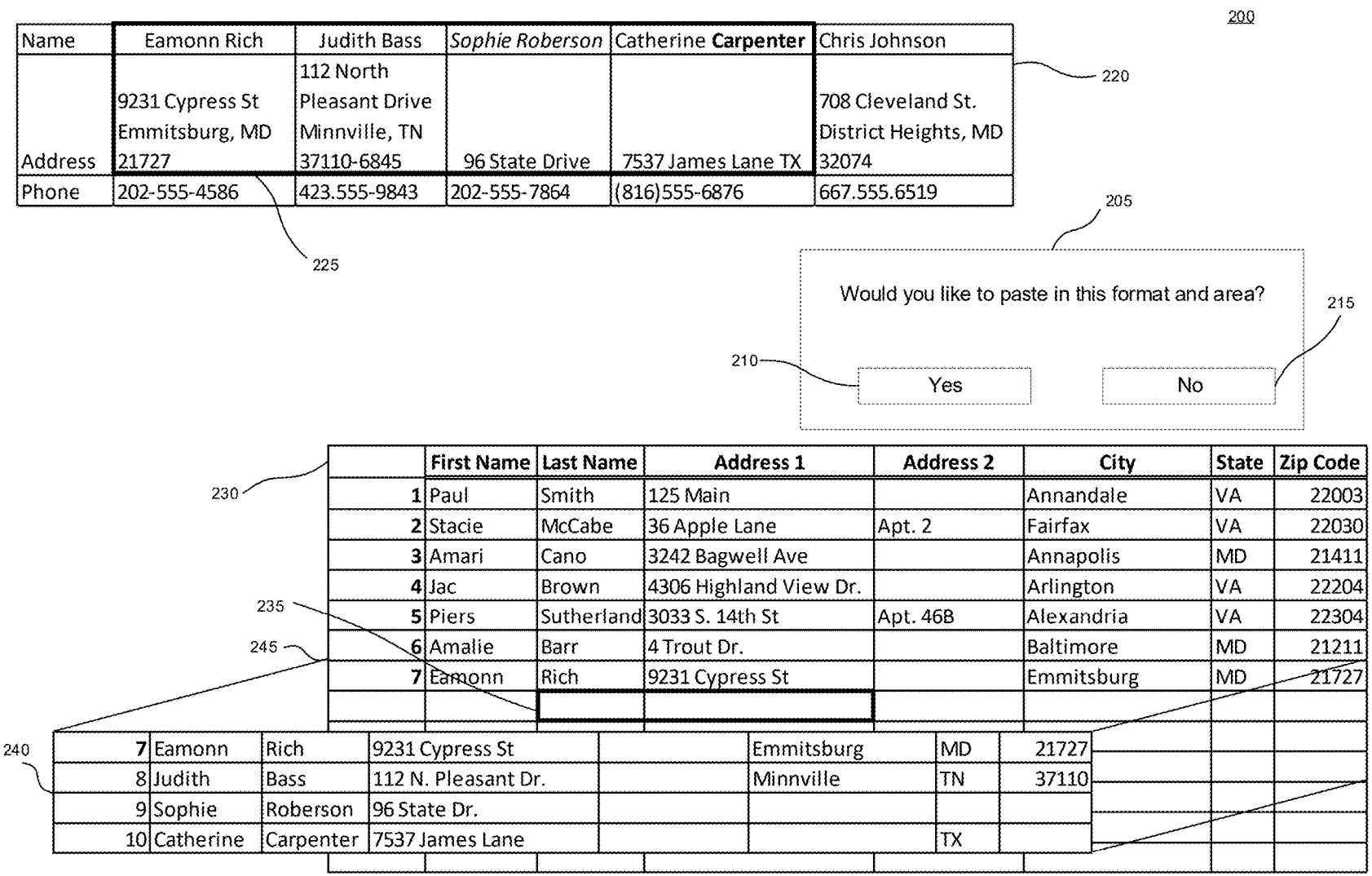
Figure 3:
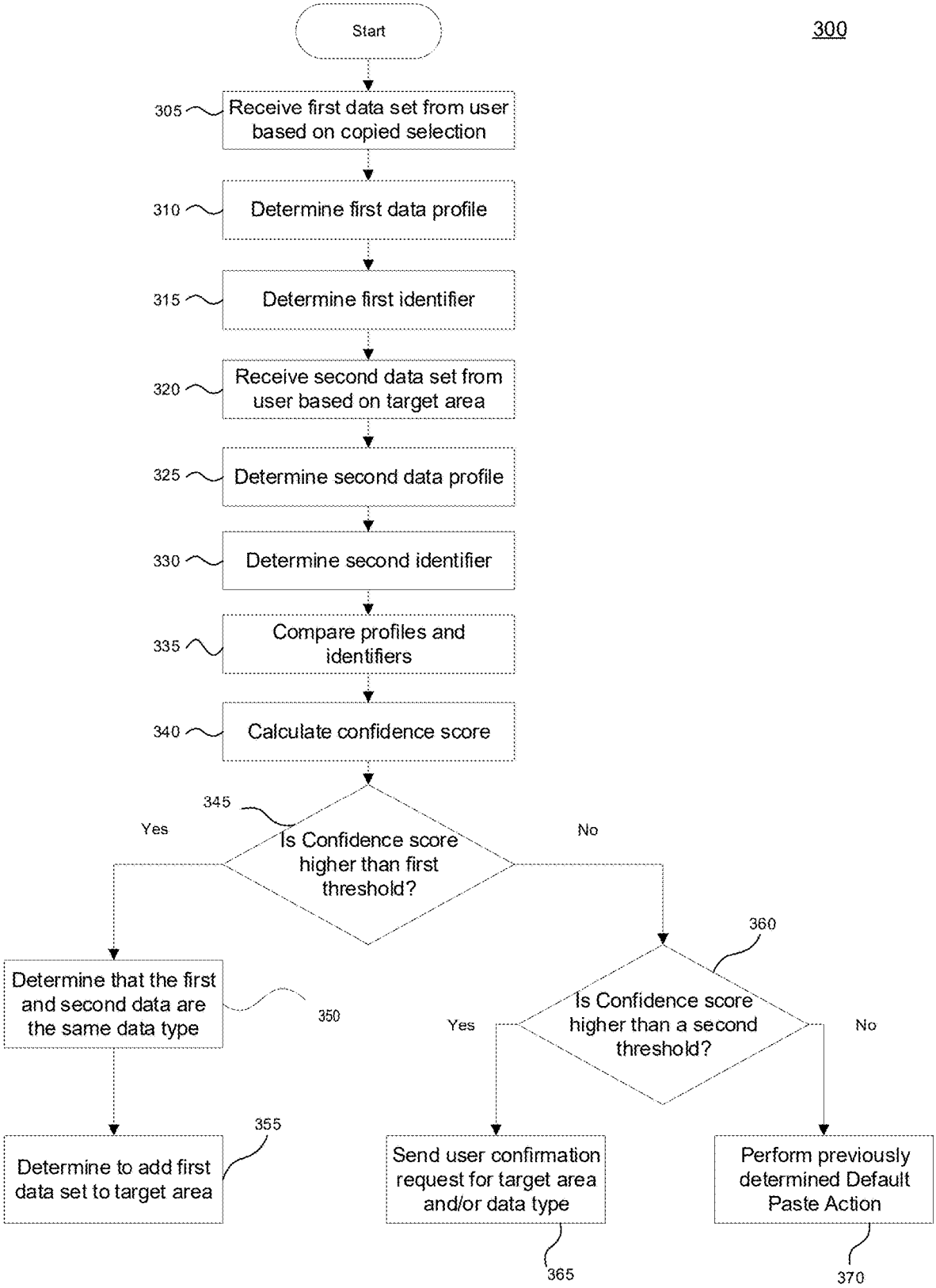
Figure 4:
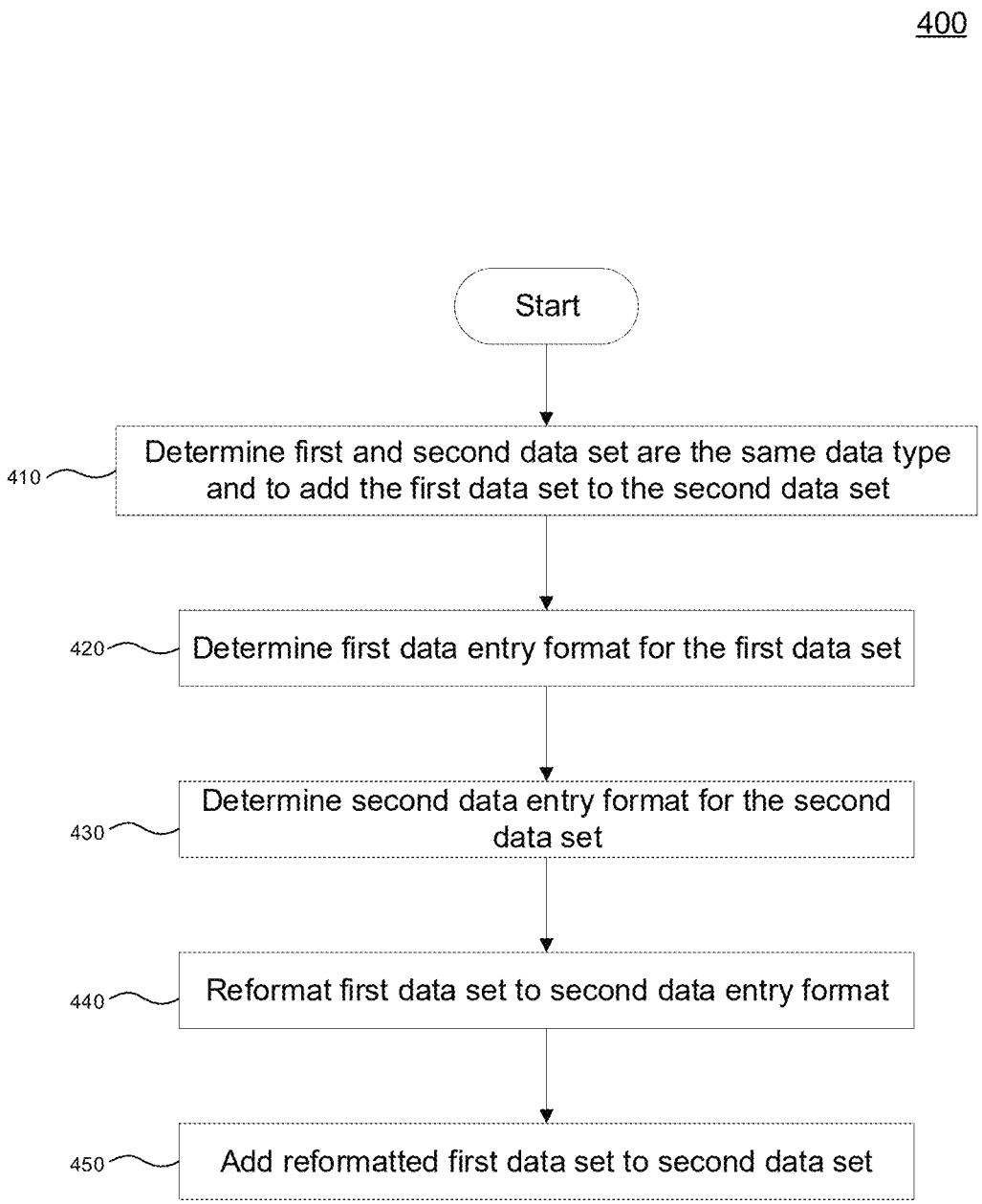

FIG. 1 illustrates the large, variable porosity pathways and pockets of the fill media to be employed in the Preferred High-Porosity Particle Mix Component Embodiment. FIGS. 2 through 5 illustrate the tubular shape to be employed in the Preferred High-Porosity Particle Mix Component Embodiment.

The below table summarizes reference numbers and descriptions contained in one or more of FIGS. 1 through 6.

Common references in two or more of FIGS. 1 through 6 indicate the same parts or features throughout the several views contained therein.

| Ref # | Reference Description |
|---|---|
| 10 | Refers to Preferred High-Porosity Particle Mix Component Embodiment |
| 12 | Refers to mesh tube sub-component of Preferred High-Porosity Particle Mix Component Embodiment |
| 14 | Refers to first end of mesh tube |
| 16 | Refers to second end of mesh tube |
| 18 | Refers to medial portion of mesh tube |
| 20 | Refers to apertures (openings) in mesh tube |
| 22 | Refers to aggregate fill media particles, or aggregate particles in short, embodied in mesh tube |
| 22a | Refers to individual fill media particles, or individual particles in short, embodied in mesh tube |
| 26 | Refers to elongate flat stripe on mesh tube |
| 30 | Refers to a Low-Permeability Choker Overlay |
| 32 | Refers to surface porosity/permeability of Low-Permeability Choker Overlay |

DESCRIPTION OF PREFERRED EMBODIMENT

The preferred embodiment of the Portable, Reusable, High-Porosity, Adjustable-Volume, Non-Filtration Flow-Regulation Device (the 'Preferred Embodiment') consists of two components, a preferred embodiment of the High-Porosity Particle Mix Component (the 'Preferred High-Porosity Particle Mix Component Embodiment'), and an optional Low-Permeability Choker Component, configured as depicted within the Figures and Photos described below.

The Preferred High-Porosity Particle Mix Component Embodiment 10 consists of the following sub-components:

(A) Aggregate fill media particles 22 consisting of a mixture of individual natural or manmade heavy, solid, differing irregular-, angular- and/or elongated-shaped, hard-wearing particles 22*a* in which:

i. the diameters of the smallest two dimensions of the aforesaid individual particles 22*a* are not less than one inch nor more than four inches (disregarding incidental smaller fragments which bypass the screening process);

ii. preferably not more than 25% of the aggregate particles 22 in terms of overall volume have diameters of less than two inches when measuring their two smallest dimensions [and more preferably between 10%-20, and most preferably about 15%];

not more than 25% of the aggregate particles 22 in terms of overall volume have diameters of more than four inches when measuring their two smallest dimensions [and more preferably between 10%-20, and most preferably about 15%];

iii. the total unsaturated combined weight of the aggregate particles 22 is not less than about 8.7 lbs. per linear foot or 1.7 lbs. per cubic foot, whichever is lesser; and iv. alternately, a form factor of an overall minimum length would preferably not exceed between two to three time a maximum diameter;

(B) a mesh tube 12 manufactured with a heavy duty, polymer material in a tubular/cylindrical configuration to contain the aforesaid aggregate particles 22, and (C) when the mesh tube 12 is filled with the aggregate fill media particles 22, the ability of the Preferred High-Porosity Particle Mix Component Embodiment 10 and each of its sub-components over the intended relatively long-term lifespan of the Preferred High-Porosity Particle Mix Component Embodiment 10 to:

i. carry the requisite weight of the chosen aggregate particles 22;

ii. bend, both in terms of placement on any given Customary Field Application, as well as being carried by workers;

iii. be used and reused as part of a similar or differently configured Customary Field Applications at the same or different locations;

iv. withstand damage from the various activities incident to use and reuse of the Preferred High-Porosity Particle Mix Component Embodiment 10 and not to break the individual fill media particles 22*a* into smaller pieces, or break the strands of the mesh tube 12, including storage, loading, unloading, dropping, manhandling, maintenance, and hazards of site traffic such as being driven over by wheeled vehicles, v. withstand potential crushing stresses and not to break the individual fill media particles 22*a* into smaller pieces, or break the strands of the mesh tube 12, including stresses arising from hydrostatic and hydrodynamic forces and the pressures of accumulated sedimentation, or the sharp or rough edges of the individual particles 22*a*, vi. resist decomposition, photo-degradation and weathering agencies, such as sunlight, extreme heat & cold, snow, ice & frost, humidity and rain, and extended submersion in bodies of water.

One version of the Preferred High-Porosity Particle Mix Component Embodiment 10 in which Applicant has conducted extensive field testing and independent performance testing (the 'Preferred 4.5" D High-Porosity Mesh Embodiment') is:

(A) A tubular configuration approximately seven feet in length and 4.5 inches in diameter, (B) employing as an aggregate fill media 22 consisting of a mix of irregular-shaped crushed concrete:

i. ranging from one to four inches in smallest two-dimensional diameter for each individual particle 22*a*, and with not less than 15% by volume less than two inches in smallest two-dimensional diameter, and not more than 15% by volume being more than three inches in smallest two-dimensional diameter, and ii. weighing approximately 70 lbs. in total for all aggregate particles 22, or 10 lbs. per linear foot of the Preferred High-Porosity Particle Mix Component Embodiment 10; and (C) employing as its encapsulating mesh tube 12 a high-density polyethylene resin mesh with ultraviolet stabilizing additives manufactured through the extrusion process.

Applicant has determined based on field and independent testing relating to performance, portability, and other criteria, that the above Preferred 4.5" D High-Porosity Mesh Embodiment is ideal in terms of utility given:

(A) an optimum size and weight of the Preferred High-Porosity Particle Mix Component Embodiment 10 to satisfy the requirement for man-portability, including having aperture 20 and strand widths allowing the High-Porosity Particle Mix Component to be gripped and carried by hand without the need for special equipment;

(B) the ability of the Preferred High-Porosity Particle Mix Component Embodiment 10 to be used individually, or as a system of stacked or otherwise assembled devices 10, for all Applications and configurations thereof;

(C) the ability of the Preferred High-Porosity Particle Mix Component Embodiment 10 to satisfy the porosity criteria necessary to eliminate clogging; and (D) the ability of the Preferred High-Porosity Particle Mix Component Embodiment 10 to satisfy the weight criteria necessary to eliminate structural instability.

It should be understood that the legal scope of the description of the Portable, Reusable, High-Porosity, Adjustable-Volume Flow-Regulation Device and its components is defined by the words of the Claims set forth at the end of this patent, and that the detailed description of the Preferred High-Porosity Particle Mix Component Embodiment 10 and the Preferred 4.5" D High-Porosity Mesh Embodiment are to be construed as exemplary only, and do not describe every possible embodiment or method of constructions such as, by way of example and not limitation:

(A) rhomboidal- or cube/cuboid-shaped configurations, or other tubular-shaped versions of the Preferred High-Porosity Particle Mix Component Embodiment 10, (B) the use of other fill media with similar characteristics in terms of solidity, weight, and the promotion of large and variable porosity pathways and pockets; and/or (C) the use of other mesh materials, since describing every possible embodiment or manner of construction would be impractical, if not impossible. Numerous alternative embodiments or manners of construction could be implemented, using either current technology or technology developed after the filing date of this patent, which would still fall within the scope of the claims.

It should also be understood that, unless a term is expressly defined in this patent, there is no intent to limit the meaning of that term, either expressly or by implication, beyond its plain or ordinary meaning, and such term should not be interpreted to be limited in scope based on any statement made in any section of this patent (other than the language of the Claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a Claim element is defined by reciting the word 'means' and a function without the recital of any structure, it is not intended that the scope of any Claim element be interpreted based on the application of 3 U.S.C. § 112 (f).

As initially discussed above, the combination of irregular shapes, sizes and overall mix of individual particles 22*a* is critical to the elimination of clogging, since it promotes variability in the size and shape of porosity pathways and pockets. Similarly, the weight of the aggregate particles 22 is equally important since it eliminates structural instability arising from hydrostatic and hydrodynamic forces as well as the pressure of accumulated sediment.

In order to address the clogging issue, the Preferred High-Porosity Particle Mix Component Embodiment 10 employs aggregate fill media particles 22 consisting of a mixture of natural or manmade heavy, solid, differing irregular-, angular- and/or elongated-shaped, hard-wearing individual fill media particles 22*a*. FIG. 1 illustrates the distribution of the aforesaid individual fill media particles 22*a* within the aggregate of all fill media particles 22 to be encapsulated in the mesh tube 12. Such distribution shows an aggregate range, shown therein as 'A' that provides a volumetric porosity density such that interstitial spaces 'B' provide a system for flow regulation that include larger, variable porosity pathways and pockets having nonlinear, multi-axial tortuous fluid flow paths 'C' there through, providing sufficiently high flow rates to avoid clogging, one of the two primary tasks at hand.

Further, in order to address the second primary task at hand, structural instability, the weight of the aggregate fill media particles 22 used in the mesh tube 12 will have a total unsaturated combined weight of not less than about 8.7 lbs. per linear foot of the Preferred High-Porosity Particle Mix Component Embodiment 10 or about 1.7 lbs. per cubic foot, whichever is lesser, providing sufficient weight to withstand hydrostatic and hydrodynamic forces as well as the pressure of accumulated sediment and otherwise hold the device in place.

The use of a mix of differing individual irregular-, angular- and/or elongated-shaped, hard-wearing individual fill media particles 22*a* are far-better suited for providing multi-axial tortuous fluid flow paths 'C' as shown in FIG. 1 than the smaller, soft, light-weight, uniformly-shaped, compact, organic, low-porosity filtration media used in Conventional Filtration Devices, due to the soft, compact, uniformly-shaped nature of the latter filtration media, resulting in much, much smaller porosity pathways and pockets than that of the fill media 22, particularly when they are saturated, due to their small, uniform size and softness.

The use of a mix of differing individual irregular-, angular- and/or elongated-shaped, hard-wearing fill media particles 22*a* are also far-better suited for providing multi-axial tortuous fluid flow paths 'C' as shown in FIG. 1 than other smooth-, flaky- or rounded (regularly)-shaped sedimentary rocks and stones, such as natural granite sourced from riverbeds or the sea, since these latter particles are regularly-shaped and much more compactible, resulting in much smaller porosity pathways and pockets Applicant's approach to the use of a mix of differing individual irregular-, angular- and/or elongated-shaped, hard-wearing fill media particles 22*a* is completely contrary and counterintuitive to that taught in the industry, which principally focuses on filtration and the use of very small particles with minimal porosity to maximize filtration. As noted in above, Applicant has essentially 'reversed' the accepted priority taught in the industry by focusing on greater porosity and flows rates to eliminate clogging as the primary consideration, and effectively disregarding the use of smaller-porosity particles, particularly in view of the availability of the Low-Permeability Choker Component 30 to address enhanced sedimentation capture if necessary. Indeed, as further noted, the Preferred High-Porosity Particle Mix Component Embodiment 10 is properly classified as a non-filtration erosion prevention and sedimentation control flow-regulation device and system, and currently represents the sole member of such class.

The fill media 22 to be employed in the Preferred High-Porosity Particle Mix Component Embodiment 10 can be either natural or manmade, so long as the other requirements regarding aggregate particle 22 and individual particle 22*a* (as the case may be) size, distribution, irregular-, angular- and/or elongated-shape, hard-wearing and weight are also satisfied. By way of example, Applicant's Preferred 4.5" D High-Porosity Mesh Embodiment employs as a fill media 22 a mix of irregular-shaped crushed concrete particles 22*a*, such as that procured from demolished or broken up driveways, etc., ranging from one to four inches in two-dimensional diameter per individual particles 22*a*, and with not more than 25% by aggregate particle volume 22 being less than two inches in two-dimensional diameter per individual particles 22*a*, and not more than 25% by aggregate particle 22 volume being more than three inches in two-dimensional diameter per individual particle 22*a*. As noted, Applicant has determined based on field and independent testing relating to performance, portability, and other criteria, that the above Preferred 4.5" D High-Porosity Mesh Embodiment is ideal in terms of utility.

Certain types of natural, hard-wearing crushed stone, such as limestone, dolomite and granite, are also good candidates for individual fill media particles 22*a*; provided that the crushing methodology employed results in irregular-, angular- and/or elongated-shapes meeting the aggregate particle 22 and individual particle 22*a* (as the case may be) size-distribution criteria.

Certain types and/or shapes of rocks and stones should be avoided in all events due to their propensity to compact with smaller, more compact, porosity pathways and pockets. These would include sedimentary rocks created by erosion, which are naturally smooth, flaky- or rounded (regularly)-shaped as a result of weathering. A good example of sedimentary rocks is natural granite, which is sourced from riverbeds or the sea. Similarly, stone which is crushed using methodologies resulting in smooth, regular, uniform shapes, such as cuboid- or flake-shapes, also suffer from compaction and limited porosity. A good example of this type of crushed stone is limestone, dolomite or granite crushed to a small, uniform, size as a substitute for natural gravel.

Advantageously, although not necessarily, sharp edges of individual fill media particles 22*a* used can be smoothed out to some extent-such as in the case of using crushed concrete pieces with particularly sharp edges—in order to reduce potential tearing of the mesh tube 12. Such smoothing of the particles 22 may be via any technique known in the art, such as rock tumbling, etc.

The mesh tube 12 sub-component is employed to contain the aggregate fill media particles 22 is porous polymer membrane that may be made from high density polyethylene, polypropylene, polyester, nylon, or other appropriate woven fabric or similar material with large apertures 20.

As shown in FIG. 2 through FIG. 6, the shape of the mesh tube 12 to be employed in the Preferred High-Porosity Particle Mix Component Embodiment 10 is tubular, formed as a closed cylinder. The mesh tube 12 has a first end 14, a second end 16 and a medial portion 18. The mesh tube 12 will contain apertures 20, such that the mesh tube 12 is formed as a porous sheath or membrane.

The strands creating the apertures 20 in the mesh tube 12 are formed in the shape of uniformly-sized diamond-shapes, designed to best address the forces and stresses to be faced. The length of the strands on the border for each aperture 20 will be slightly smaller than the general, mean or average size of the smallest dimension of individual particle 22*a* diameter to be employed in the Preferred High-Porosity Particle Mix Component Embodiment 10 This aperture 20 opening size will maintain the containment of the aggregate fill media particles 22 and prevent any individual particle 22*a* from egressing from the mesh tube 12, while otherwise ensuring that the uniform aperture 20 sizes will allow as much water as possible to flow through the Preferred High-Porosity Particle Mix Component Embodiment 10 without restriction by the aperture 20 strand. See FIG. 10 illustrating the diamond shape of the aperture, the width of the strands, and the slightly-smaller size of the diamond-shaped apertures relative to the diameter of the individual fill media particles 22*a*.

The width and strength, durability and toughness of the mesh tube 10 strands are, as a general proposition, a function of (1) the shape of the mesh tube 12 and (2) the weight, shapes, diameters and characteristics of the aggregate fill media particles 22 to be contained in such mesh tube 12. By way of example, the Preferred 4.5" D High-Porosity Mesh Embodiment requires approximately 24 cubic feet of aggregate fill media 22, while the same device 10 with a 6.5-inch diameter would require approximately 47 cubic feet of aggregate fill media 22. Accordingly, the mesh tube 12 will need to be substantially stronger to hold the greater weight and withstand the greater pressures attributable to such increased weight. The specific strand specifications may be determined through ordinary civil engineering analysis, including addressing issues such as aggregate fill media weight 22 and weight per pmsf, tensile, elongation and grab strength, tear and puncture resistance, and ultraviolet stability.

The mesh tube 12 may be either seamed, which is preferable for reasons described below, or non-seamed. As provided in the prior art, mesh tubes 12, for example such as those made from polymers or other plastic materials, chicken wire and the like, can be made from a relatively flat sheet of mesh material that is subsequently rolled into a cylinder to where the two lateral sides meet and are attached to each other in some fashion such as via wire ties so that a seam is formed along the length of the mesh tube 12 so formed. Alternately provided in the prior art, the use of a mesh tube 12 formed from polymers or other plastic materials can also be similarly formed from a rolled flat sheet that is welded or connected via adhesion so as to similarly produce the longitudinal seam. The aforesaid manners of mesh cylinder formation result in the placement of stress points at the joinder of the two sides of the mesh sheet (along the seam). This creates a zone for increased failure potential at the connection points in that radial stresses on these types of devices are much greater than longitudinal stresses at the ends of the High-Porosity Particle Mix Components. By using a closed mesh cylinder (non-seamed mesh cylinder) of the present teachings, such attachment points and their associated sources for potential failure are eliminated. Alternatively, the mesh tube 12 may be formed into a closed cylinder during mesh manufacture. For example, the mesh tube 12 may be formed via extrusion in a continuous loop (closed cylinder) manner without any longitudinal seam formed and thereby eliminating this source of potential tube failure.

Figure 5:
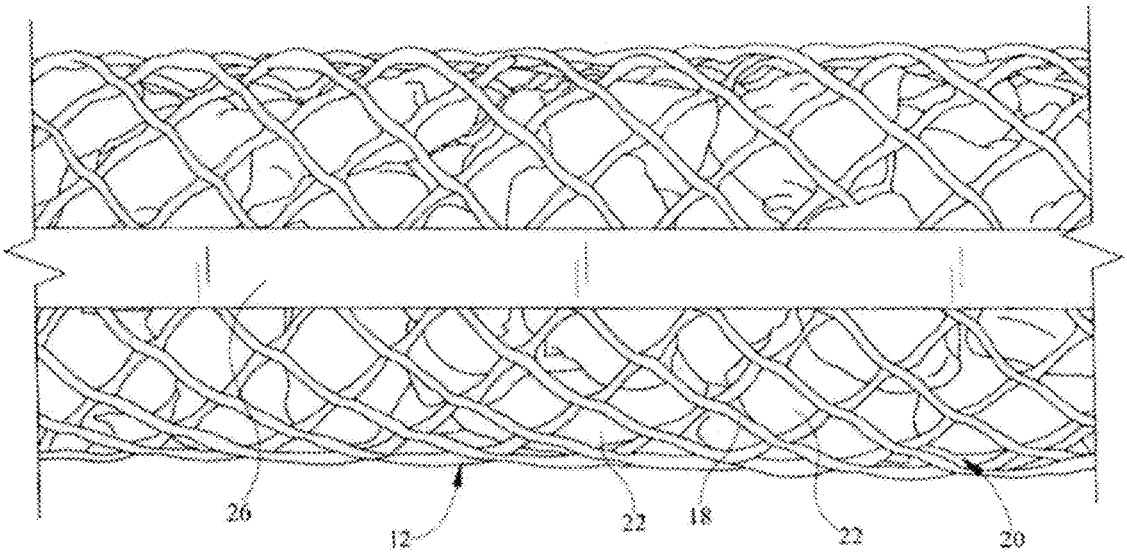

As shown in conjunction with FIG. 5, an elongate flat stripe 26 may be located along a length of the mesh tube 12. The stripe 26 is either formed integrally with the mesh tube 12 or attached to the mesh tube 12 in appropriate fashion (ultrasonic welding, heat welding, adhesion, tie, etc.), the stripe 26 advantageously being made from the same polymer used to make the mesh tube 12, although the stripe can be formed from other material such as aluminum. The stripe 26 allows instructions, advertising, or other useful information to either be imprinted thereon during stripe production or attached thereto via an appropriate label, marker or the like (not shown).

The Preferred High-Porosity Particle Mix Component Embodiment 10 is formed by first fabricating the mesh tube 12, including sealing the first end of the tube 14, and then filling the mesh tube 12 with the selected aggregate fill media 22, and sealing the second end of the tube 16.

The mesh tube 12 can be fabricated in a number of ways. As discussed above, the preferred fabrication method is to engage a plastic nettings manufacturer to manufacture the mesh per specification via extrusion in a continuous loop (closed cylinder) manner without any longitudinal seam formed. This method is most beneficial first because it eliminates sources of potential tube failure, and also because it eliminates labor and materials costs which would be incurred to otherwise manually cut and seam the mesh tube into the desired tubular configuration. Upon receipt of the pre-cut extruded mesh tube 10, Applicant will then seal the first end 14 of the mesh tube 12 appropriate clips or ties or via appropriate welding (ultrasonic, heat, etc.) and hold the mesh tube 12 for filling as discussed below.

Alternatively, the plastics netting manufacturer can manufacture a roll of flat (e.g., non-tubular) mesh material which can then be pre-cut to specifications by the manufacturer or sold as a roll to Applicant who will then cut to specification from the roll. Once cut to a desired length and width, the longitudinal sides of the mesh material may be closed or sealed to complete that side of the cylinder with appropriate clips or ties or via appropriate welding (ultrasonic, heat, etc.). Thereafter the first end 14 of the mesh tube 12 will be similarly closed or sealed with appropriate clips or ties or via appropriate welding (ultrasonic, heat, etc.).

At this point the mesh may be filled with the aggregate fill media 22, either manually or via some type of automated filling device, or a combination thereof. Thereafter the second end 16 of the mesh tube 12 will be closed or sealed with appropriate clips or ties or via appropriate welding (ultrasonic, heat, etc.), resulting in a completely filled and sealed cylinder. The Preferred High-Porosity Particle Mix Component Embodiment 10 is now ready for use and can be sold and used at an appropriate site as desired. See FIG. 11 for an illustration of a filled Preferred High-Porosity Particle Mix Component Embodiment 10

Given the hard-wearing nature of the fill media 22, the life-span of the Preferred High-Porosity Particle Mix Component Embodiment 10 will principally turn-on the lifespan of the mesh tubing, 12 which, in turn, will be dependent upon the resistant of the mesh tubing to (1) damage from photo-degradation, or decomposition as a result of exposure to ultra-violet rays, or (2) any other cause. Based upon the additives contains in Applicant's current polymer formulation, the mesh tube should have a lifespan of up to five years assuming consistent exposure to the sun. Were the Preferred High-Porosity Particle Mix Component Embodiment 10 to be placed outside direct exposure to the sun, such as being placed at the bottom of an assembly, or in covered storage, then the lifespan would be longer. Relative to damage from broken strands, which would be the likely damage, the damaged aperture 20 can be quickly, inexpensively and permanently re-joined using a simple cable or similar tie (not shown). When the Preferred High-Porosity Particle Mix Component Embodiment 10 has reached the end of its useful like, the individual fill media 22*a* may be reused in a new device 10, and the mesh tube 12 disposed of in appropriate fashion.

The present invention may be used in a situation where a lower flow rate or a higher sedimentation capture rate is required for any given Customary Field Application. A user may easily, quickly and inexpensively adjust or modulate the operation of the Preferred High-Porosity Particle Mix Component Embodiment 10 by simply constricting or 'choking' the water flow rate into the Preferred High-Porosity Particle Mix Component Embodiment 10 by wrapping a Low-Permeability Choker Wrap 30 around the Preferred High-Porosity Particle Mix Component Embodiment 10 or an assembly of such devices 10, or overlaying a Low-Permeability Choker Overlay 30 on the upstream face of the Preferred High-Porosity Particle Mix Component Embodiment 10 or an assembly of such devices 10. See FIG. 6.

In operation, the Low-Permeability Choker Component 30 chokes or restricts the flow rate of the sediment-laden water into the Preferred High-Porosity Particle Mix Component Embodiment 10, which results in an increase in the size of the upstream settling pond and a corresponding increase in the amount of sediment captured in the pond through the settling process. As such, the Preferred High-Porosity Particle Mix Component Embodiment 10 and the Low-Permeability Choker Component 30 operate as a system to prevent erosion and control sedimentation.

The geotextile material 30, which can be either woven or non-woven, will have a selected weight and associated permeability level which will facilitate a reduction in the anticipated flow rate into the High-Porosity Particle Mix Component 30 to the targeted lower level, and increase the anticipated corresponding sedimentation capture rate in the upstream settling pond to a corresponding targeted higher rate. One of the lightest-weight geotextile material 30, such as a 3.1-ounce weight, would have a less-restrictive permeability level and typically constrict flow rates to about 150 gallons per minute per sq. ft., while one of the heaviest-weight geotextile material 30, such as a 16-ounce weight, would have a much more-restrictive permeability level and typically constrict flow rates to about 50 g.p.m. per sq. ft., or one-third of the referenced lighter weight material. The specific type and weight of the geotextile material 30 may be determined through ordinary civil engineering analysis for a given Customary Field Application. Applicant has found that a woven geotextile material with a 4-ounce weight works very well for most Customary Field Applications, typically lasting for at least a month before requiring replacement.

Figure 6:
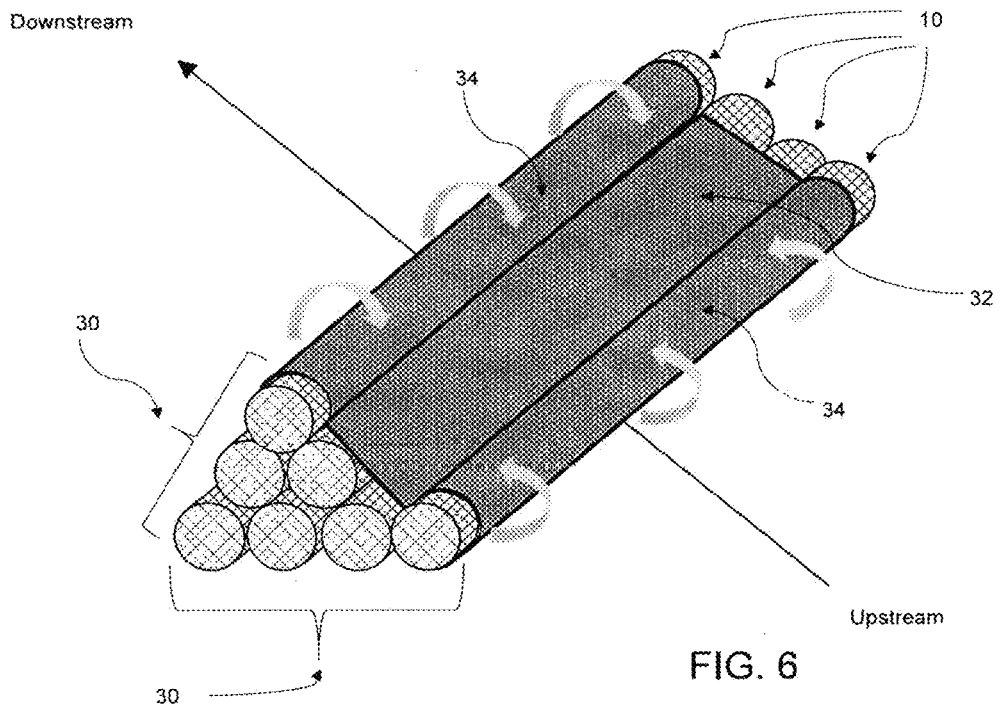
Figure 7:
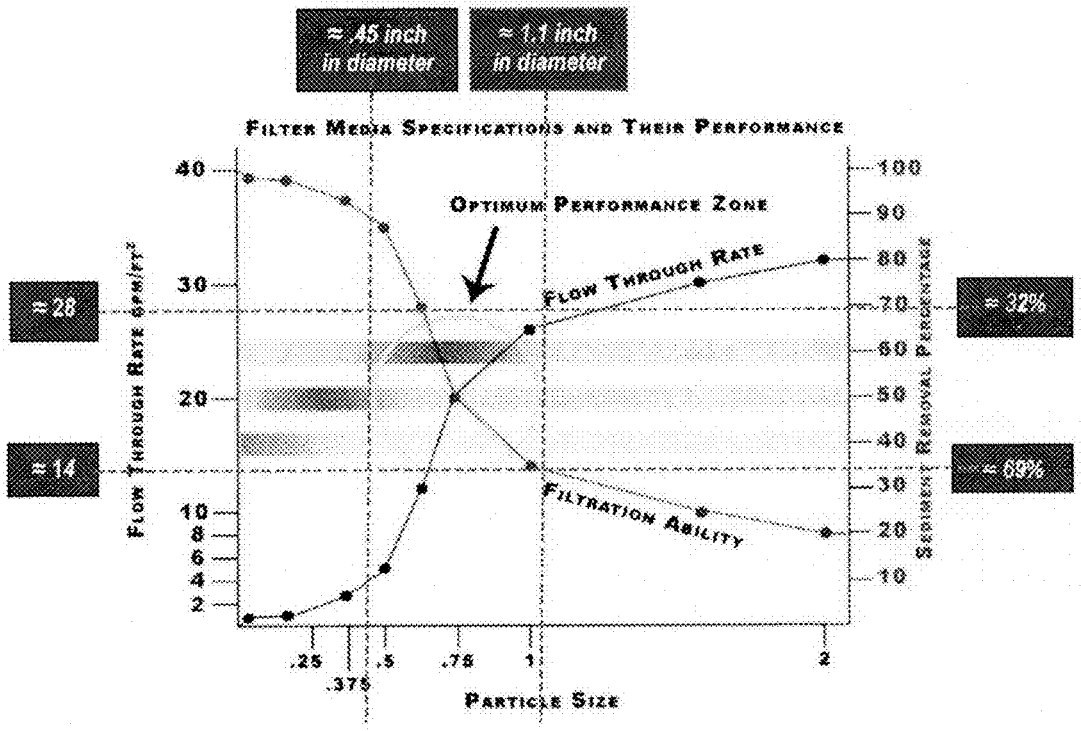
Figure 8:
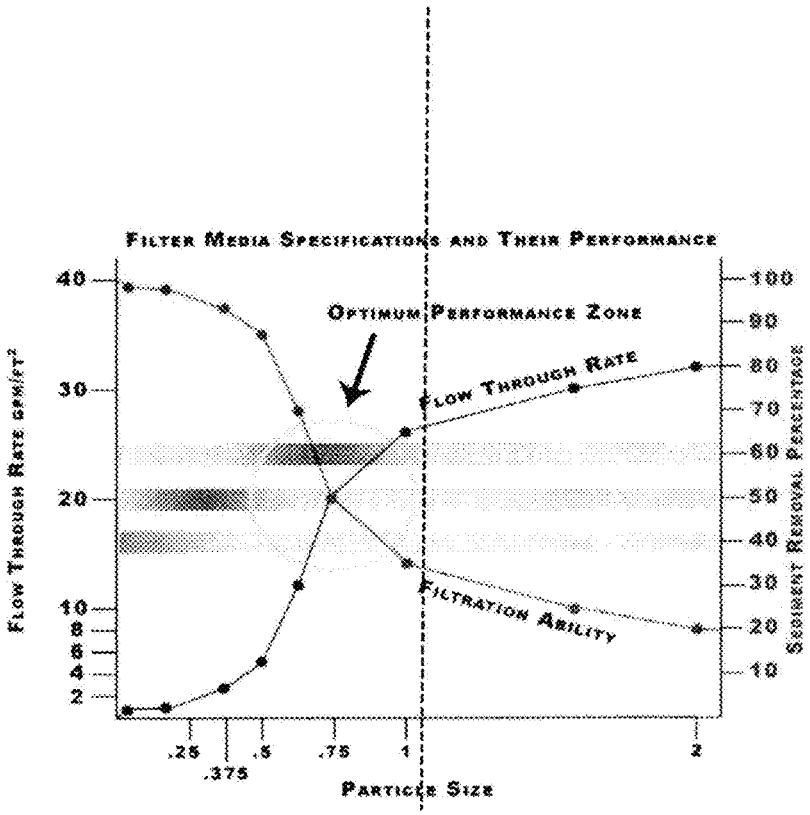
FIG. 8 is a chart showing '90% passing a 0.75 inch sieve, a minimum of 70% greater than a 0.375 inch sieve')
Figure 13:
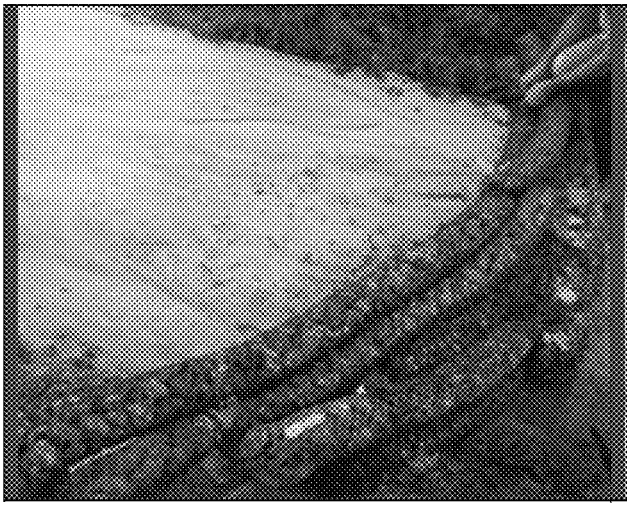
FIG. 13 is an environmental illustration of a small-scale check dam assembly employing Applicant's Preferred 4.5" D High-Porosity Mesh Embodiment at the base of a 15° slope.
Figure 14:
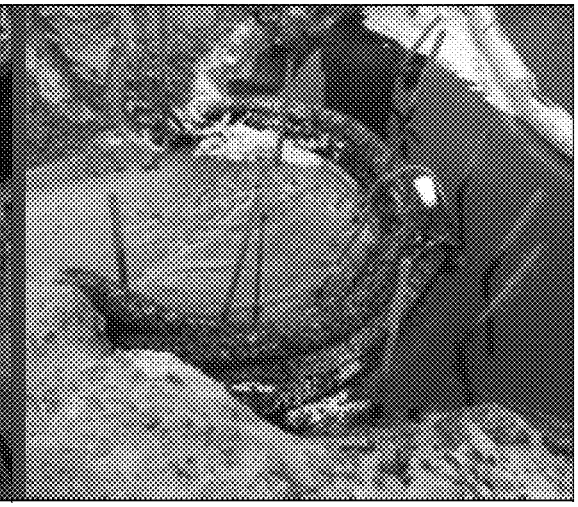
FIG. 14 is an environmental illustration of a large road culvert inlet assembly employing Applicant's Preferred 4.5" D High-Porosity Mesh Embodiment.
Figure 15:
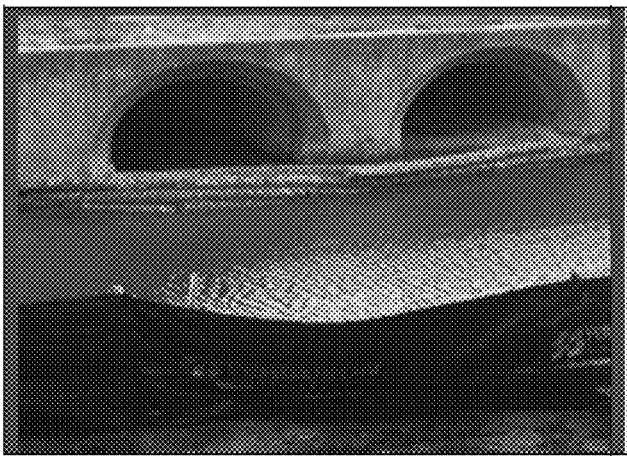
FIG. 15 is an environmental illustration of a large-scale road culvert inlet assembly employing Applicant's Preferred 4.5" D High-Porosity Mesh Embodiment.
Figure 16:
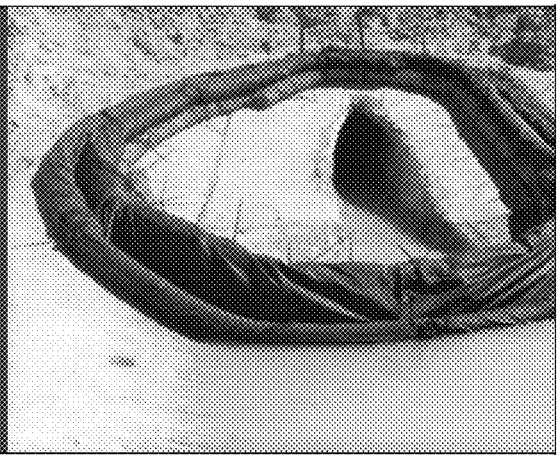
FIG. 16 is an environmental illustration of a small-scale culvert inlet assembly employing Applicant's Preferred 4.5" D High-Porosity Mesh Embodiment with a Low-Permeability Choker Overlay.
Figure 17:
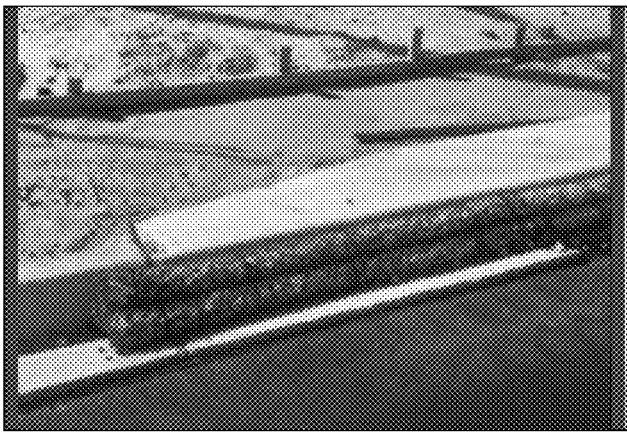
FIG. 17 is an environmental illustration of a curb inlet assembly employing Applicant's Preferred 4.5" D High-Porosity Mesh Embodiment.
Figure 18:
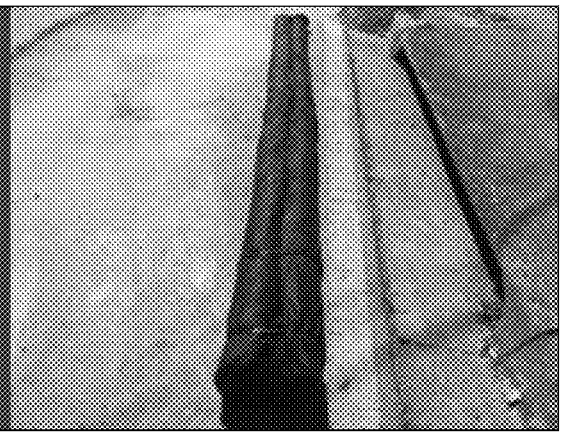
FIG. 18 is an environmental illustration of a curb inlet assembly employing Applicant's Preferred 4.5" D High-Porosity Mesh Embodiment with a Low-Permeability Choker Wrap.
Figure 19:
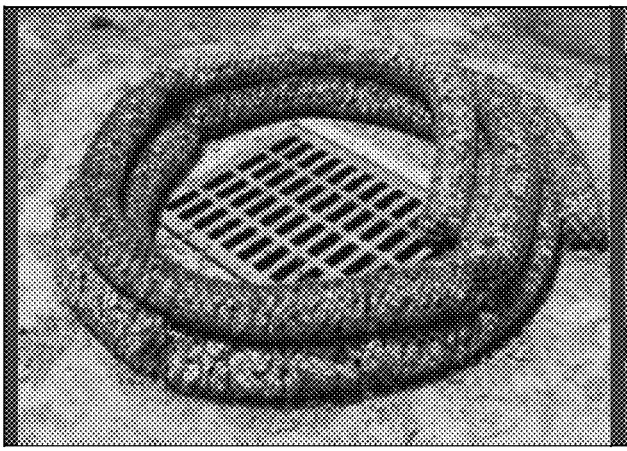
FIG. 19 is an environmental illustration of a small-scale ground inlet assembly employing Applicant's Preferred 4.5" D High-Porosity Mesh Embodiment.
Figure 20:
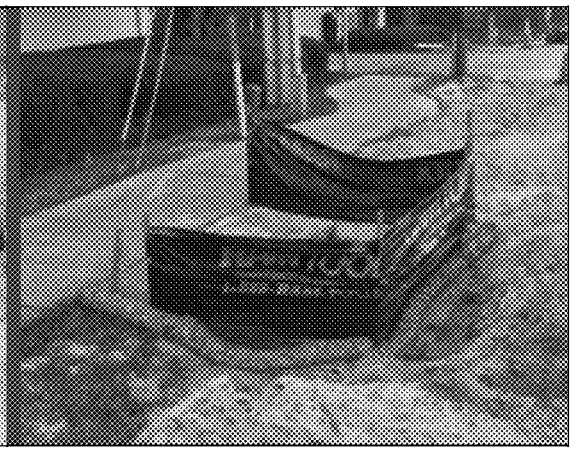
FIG. 20 is an environmental illustration of a support assembly employing Applicant's Preferred 4.5" D High-Porosity Mesh Embodiment for a silt fence.
Figure 21:
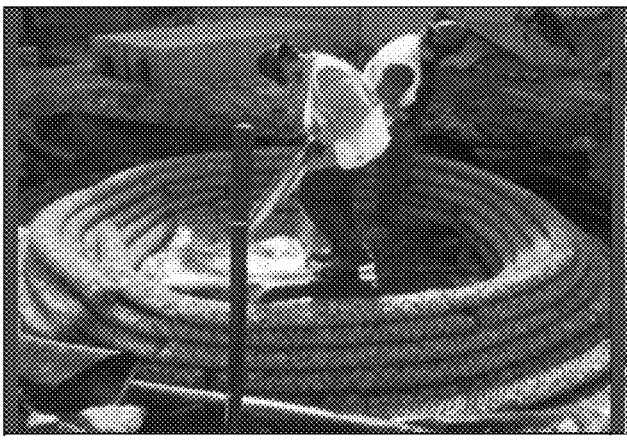
FIG. 21 is an environmental illustration of a large-scale ground inlet assembly employing Applicant's Preferred 4.5" D High-Porosity Mesh Embodiment.
Figure 22:
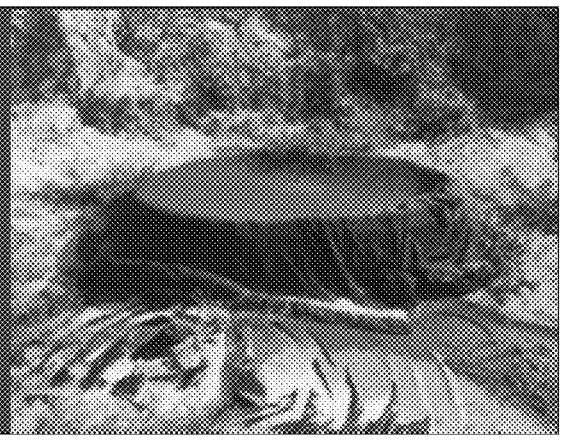
FIG. 22 is an environmental illustration of a large-scale ground inlet assembly employing Applicant's Preferred 4.5" D High-Porosity Mesh Embodiment with a Low-Permeability Choker Overlay.
Figure 23:
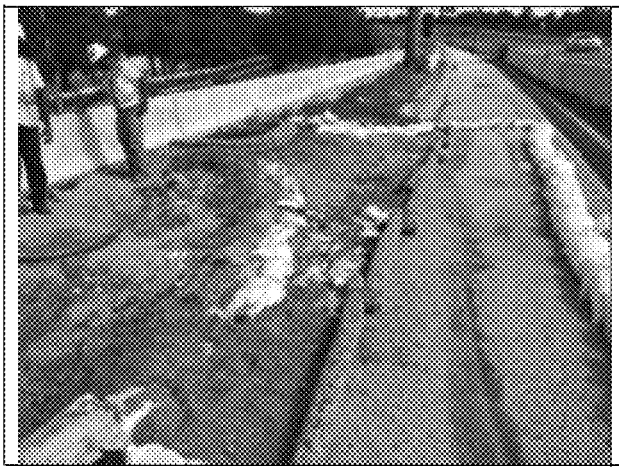
FIG. 23 is an environmental illustration of a single-line perimeter control assembly employing Applicant's Preferred 4.5" D High-Porosity Mesh Embodiment.
Figure 24:
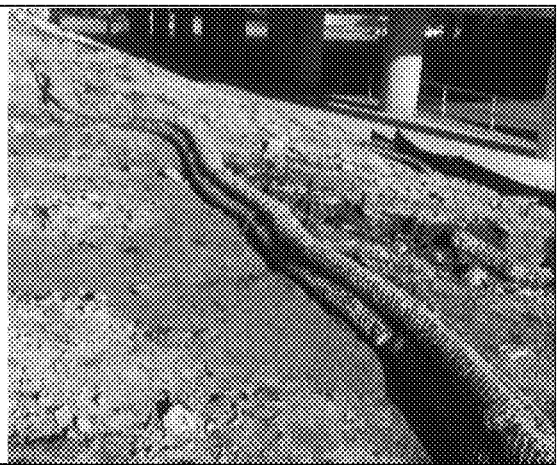
FIG. 24 is an environmental illustration of a double-line slope control assembly employing Applicant's Preferred 4.5" D High-Porosity Mesh Embodiment.
Figure 25:
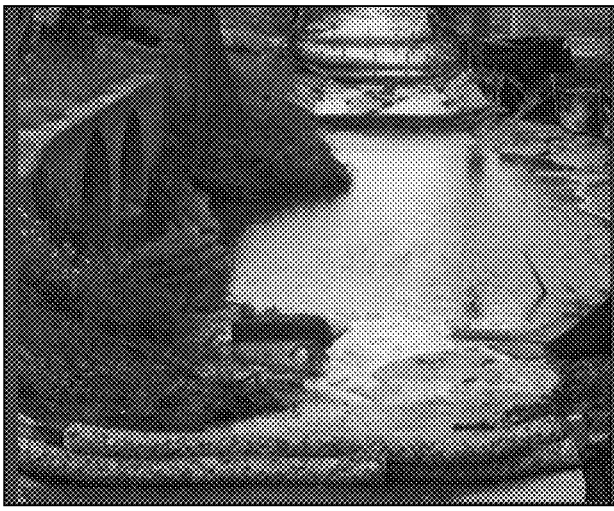
FIG. 25 is an environmental illustration of a series of check dam and culvert assemblies employing Applicant's Preferred 4.5" D High-Porosity Mesh Embodiment.
Figure 26:
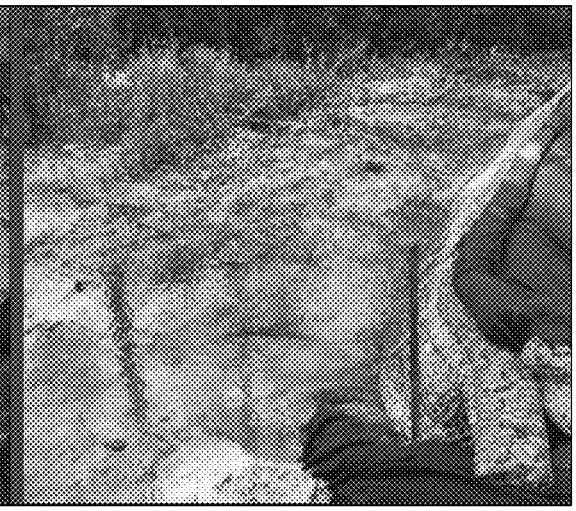
FIG. 26 is an environmental illustration of a support assembly employing Applicant's Preferred 4.5" D High-Porosity Mesh Embodiment with a Low-Permeability Choker Overlay for drainage from a large sediment settling pond over a property line into environmentally-protected wetlands.
Figure 27:
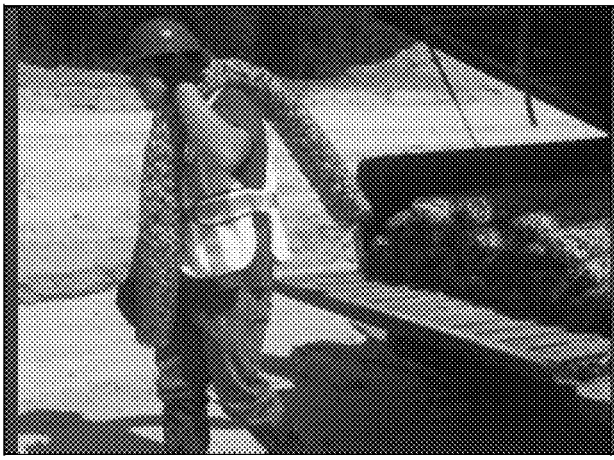
FIG. 27 illustrates portability of Applicant's Preferred 4.5" D High-Porosity Mesh Embodiment.

As shown in conjunction with FIG. 6 illustrating the placement of a Low-Permeability Choker Overlay 30 in a check dam-type stacked assembly, a low-porosity geotextile material 30 having a second surface porosity 32 is overlaid on the upstream face of the assembly to 'choke' or constrict water flow as it enters into the mesh tubes 12, and increase sedimentation capture. The Low-Permeability Choker Component 30 can be installed in several different way. For example, where installation is required for only one or two Preferred High-Porosity Particle Mix Component Embodiment(s) 10, such as for a curb inlet, the Preferred High-Porosity Particle Mix Component Embodiment(s) 10 may be simply wrapped with a Low-Permeability Choker Wrap. See FIG. 19 Alternatively, where a system of Preferred High-Porosity Particle Mix Component Embodiments 10 are stacked in a linear manner, such as for a check dam or settling pond, a Low-Permeability Choker Overlay 30 can be cut to mirror the upstream face of the stack, and secured by rolling the top and bottom portions of the material in a separate Preferred High-Porosity Particle Mix Component Embodiment 10, or line of separate Preferred High-Porosity Particle Mix Component Embodiments 10, running along the top and bottom of the stack, respectively. See FIG. 26 In the case of a large ground inlet encircled by an assembly of Preferred High-Porosity Particle Mix Component Embodiments 10, a Low-Permeability Choker Overlay 30 can be simply laid over the top and sides of the encirclement, and secured at ground level by, once again, being wrapped in a line of Preferred High-Porosity Particle Mix Component Embodiment s 10 laying on the ground adjacent to the sides of the stack. See FIG. 22.

Should the Low-Permeability Choker Component 30 become clogged, it can be easily, quickly and inexpensively replaced in a matter of minutes without any need to replace, or even flush out, the underlying Preferred High-Porosity Particle Mix Component Embodiment(s) 10 or assembly of Preferred High-Porosity Particle Mix Component Embodiment(s) 10. Because of the structural stability of the Preferred High-Porosity Particle Mix Component Embodiment (s) 10 which lends its stability to the Low-Permeability Choker Component 30, the Low-Permeability Choker Component 30 is not overwhelmed or pushed aside as is the ordinary case.

The use of the Low-Permeability Choker Component 30 to reduce water flow and increase the capture of sedimentation has proven to work extraordinarily well, with levels equal to or exceeding that of Conventional Filtration Devices. As previously discussed, under each of three flow-through scenarios independently tested by AU-HRC, a check dam assembly with an 8-ounce medium permeability Low-Permeability Choker Overlay 30 reduced turbidity reduction to zero and captured at least 91% of sedimentation in the sedimentation deposition layer, equaling or exceeding the top performing Conventional Filtration Devices. Based upon Applicant's experience, the user may select a Low-Permeability Choker Component 30 employing a woven geotextile with a range of weights and permeabilities, ranging from 3.1 ounces (lightest) to 16 ounces (heaviest), in order to modulate the sedimentation capture rate to fit a target range.

In operation of the preferred embodiment of the present invention, the openings of the mesh tube are slightly smaller than the general, mean or average size of the rock used within the mesh tube. This maintains containment of the fill and prevents rock egress from the mesh tube. The rock filled non-seamed mesh tube for flow control is formed by taking a desired length, which can be precut during mesh tube manufacture. The first end may be closed, or the mesh tube can be manufactured with the first end already closed with appropriate ties or via appropriate welding (ultrasonic, heat, etc.). The interior medial portion of the mesh tube is filled with the rocks and thereafter the second end is closed in similar fashion to the closure of the first end 14. In operation of the preferred embodiment of the present invention, the openings of the mesh tube are slightly smaller than the general, mean or average size of the rock used within the mesh tube. This maintains containment of the fill and prevents rock egress from the mesh tube. The rock filled non-seamed mesh tube for flow control is formed by taking a desired length, which can be precut during mesh tube manufacture. The first end may be closed, or the mesh tube can be manufactured with the first end already closed with appropriate ties or via appropriate welding (ultrasonic, heat, etc.). The interior medial portion of the mesh tube is filled with the rocks and thereafter the second end is closed in similar fashion to the closure of the first end 14.

When the rock filled non-seamed mesh tube for flow control 10 becomes sufficiently soiled so as to no longer be properly functional, the rock laden mesh tube 12 is moved to an appropriate wash area (or washed on site) and a high pressure stream of water, possibly having an appropriate detergent, is applied to the rock filled non-seamed mesh tube for flow control 10 in order to dislodge sediment and otherwise clean the device. The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples, and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way. Any unintended embracement of such subject matter is hereby disclaimed.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. A system for water flow regulation and erosion prevention and sedimentation control comprising:

an extruded plastic mesh element forming a three dimensional tubular shape, having a first porous membrane adapted for a regulated fluid communication and forming a retention volume, said first porous membrane comprising opening diameters ranging from 0.5 mm to 5 mm;

a fill media populating the retention volume, the fill media comprising a mixture of individual natural or manmade solid particles with shapes selected from differing irregular, angular, and elongated shapes; forming non-linear multi-axial tortuous fluid flow pathways within the retention volume with a porosity of 20% to 40%, and sufficient weight to maintain structural integrity against hydrostatic and hydrodynamic forces;

wherein the fill media comprises particles having average diameters between 1 inch and 4 inches, with at least 75% of the particles having diameters exceeding 2 inches, wherein the fill media includes crushed concrete, and wherein the fill media provides a 4:1 volume ratio of mixed sized material to fluid flow pathways to create a tortuous path for water passage while restricting sediment.

2. The system of claim 1, wherein the mesh element is formed of a polymeric material selected from a group consisting of: a high density polyethylene; a high density polypropylene; a high density polyester; and a Nylon.

3. The system of claim 2, wherein the mesh element is seamlessly formed by extrusion in a continuous loop.

4. The system of claim 2, wherein the fill media is selected from a group consisting of: natural concrete; crushed concrete; stones; rocks; and a combination thereof.

5. The system of claim 1, wherein the mesh element is seamlessly formed by extrusion in a continuous loop.

6. The system of claim 1, wherein the fill media comprises natural or crushed concrete, stone or rocks with differing irregular, angular, and/or elongated shapes.

7. The system of claim 1, whereas the fill media comprises:

about 15% of the aggregate in terms of overall volume has diameters of more than four inches.

8. The system of claim 1, further comprising a synthetic geotextile material forming at least a portion of one or more mesh elements overlaid over the top or over the upstream face of one or more mesh elements, adapted such that as a water flow rate into the system is decreased, a sedimentation capture rate in an upstream settling pond is correspondingly increased.

9. The system of claim 8, wherein the geotextile material is further adapted to create a targeted water flow rate into the system.

10. The system of claim 1, configured and arranged in a specific configuration selected from a group consisting of: linearly; in parallel; stacked; and assembled to form a three-dimensional runoff and control structure; wherein the specific configuration is adapted for a specific erosion prevention and sedimentation control application.

11. The of claim 10, wherein said plurality of water flow and sediment control devices are reconfigured to a differently configured three-dimensional runoff and control structure.

12. A device for water flow regulation and erosion prevention and sedimentation control comprising:

an outer plastic mesh element forming a three-dimensional shape having a first porous membrane forming a retention volume, said first porous membrane comprising openings having diameters ranging from 0.5 mm to 5 mm; and a fill media populating the retention volume, the fill media comprising a mixture of individual natural or handmade particles forming nonlinear, multi axial tortuous fluid flow pathways and pockets within the retention volume, said particles having shapes selected from differing irregular, angular and elongated shapes with average diameters not less than one inch nor more than four inches, and not more than 25% of the fill media particles having diameters of less than two inches when measuring their two smallest dimensions, and not more than 25% of the aggregate particles in terms of overall volume have diameters of more than four inches when measuring their two smallest dimensions.

13. The device for water flow regulation and erosion prevention and sedimentation control of claim 12, wherein the fill media further comprises:

about 15% of the aggregate particles in terms of overall volume have diameters of more than four inches when measuring their two smallest dimensions; and a sufficient weight to ensure the maintenance of structural integrity against hydrostatic and hydrodynamic forces and the pressures of accumulated sedimentation.

14. The device for water flow regulation and erosion prevention and sedimentation control of claim 12, wherein the total unsaturated combined weight of the aggregate particles is not less than 8.7 lbs. per linear foot for tubular shapes or 1.7 lbs. per cubic foot for cuboid shapes.

15. The device for water flow regulation and erosion prevention and sedimentation control of claim 12, further comprising:

a replaceable low-permeability choker component or overlaid covering at least an upstream surface portion of the three-dimensional shape, said choker component replaced in order to modulate a sedimentation capture rate to fit a target range.

16. The device for water flow regulation and erosion prevention and sedimentation control of claim 15, wherein said choker component comprises a generally planar synthetic geotextile material with a permeability ranging between from about 3.1 ounces to about 16 ounces.

* * * * *